United States Patent [19]

Sanders

[11] Patent Number: 4,949,866

[45] Date of Patent: Aug. 21, 1990

[54] REFUSE CONTAINER COVER

[76] Inventor: Glen D. Sanders, 1372 Sierra Alta, Tustin, Calif. 92680

[21] Appl. No.: 307,615

[22] Filed: Feb. 7, 1989

[51] Int. Cl.[5] ..... B65D 43/16

[52] U.S. Cl. ..... 220/334; 220/908; 220/72

[58] Field of Search ..... 220/334, 1 T, 72

[56] References Cited

U.S. PATENT DOCUMENTS

| | | | |
|---|---|---|---|
| 3,401,817 | 9/1968 | Palson | 220/334 |
| 4,199,075 | 4/1980 | Rohrer | 220/334 |
| 4,771,940 | 9/1988 | Taylor | 220/335 |

OTHER PUBLICATIONS

Duraflex advertisement (Container Components) (date unknown).
Par-Kan advertisement (Parker Industries) (date unknown).
Teem advertisement (Teem Enterprises, Inc.) (date unknown).
Poly-Lid advertisement (Poly-Lid) (date unknown).
Ameri-Kan advertisement (Ameri-Kan) (date unknown).
Competitor advertisement (The CRW Group, Inc.) (date unknown).
Hesco Rota-Mold (Hesco Sales, Inc. and U.S. Container Corp.) advertisement (date unknown).
The Brenner Container advertisement (Brenner Equipment Corp.) (date unknown).
Riblet advertisement (Riblet Products, Inc.) (date unknown).
Leland advertisement (Leland Engineering, Inc.) (date unknown).
RMI advertisement (Rotational Molding, Inc.) (date unknown).
Kirk Supercart advertisement (Kirk Rotational Molding, Inc.) (date unknown).

*Primary Examiner*—Donald F. Norton
*Attorney, Agent, or Firm*—Stetina and Brunda

[57] ABSTRACT

Disclosed is an improved cover or door for a bin type refuse container. In a preferred two-piece embodiment the invention comprises an upper member and a lower member joined together to form a generally unitary structure. A plurality of water channeling troughs or ribs are formed on the upper surface (upper member) of the cover. A plurality of support ribs are formed on the lower surface (lower member) of the member. In a preferred single piece embodiment, the invention comprises a ribbed, grooved, channeled, or corrugated platform member with lips or flanges extending downwardly from the periphery thereof so as to form a grooved, ribbed, channeled or corrugated platform like member with a slightly concaved underside. A plurality of support rods, tubes or other members extend across the underside of the platform like member abutting against the opposing edge lips or flanges. Two of these single piece covers may be formed simultaneously by rotomolding with subsequent severence of the rotomolded part into two mirror-image halves. In both the single piece and double piece embodiment, the upper surface may be peaked, arched or bowed to facilitate channeling and runoff of rainwater.

11 Claims, 2 Drawing Sheets

Fig. 1
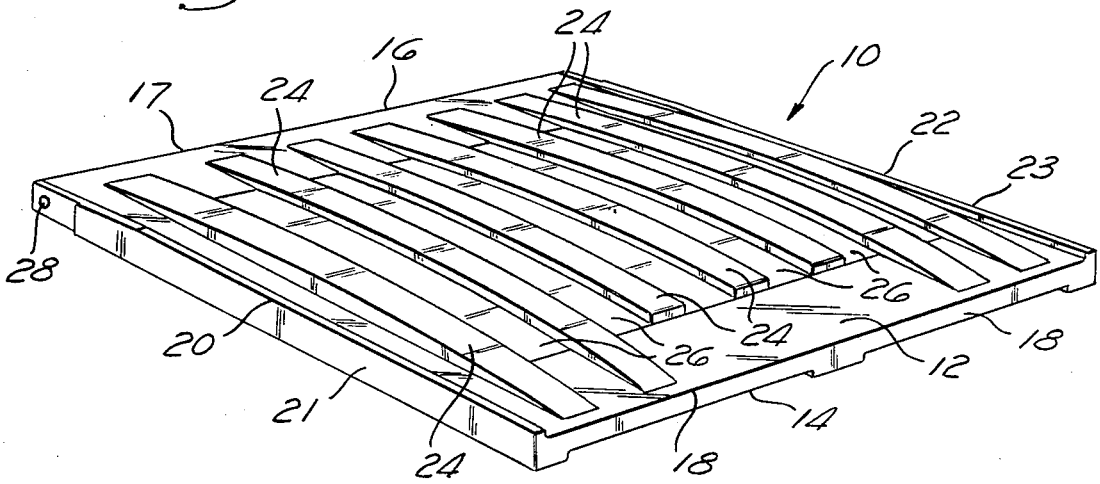
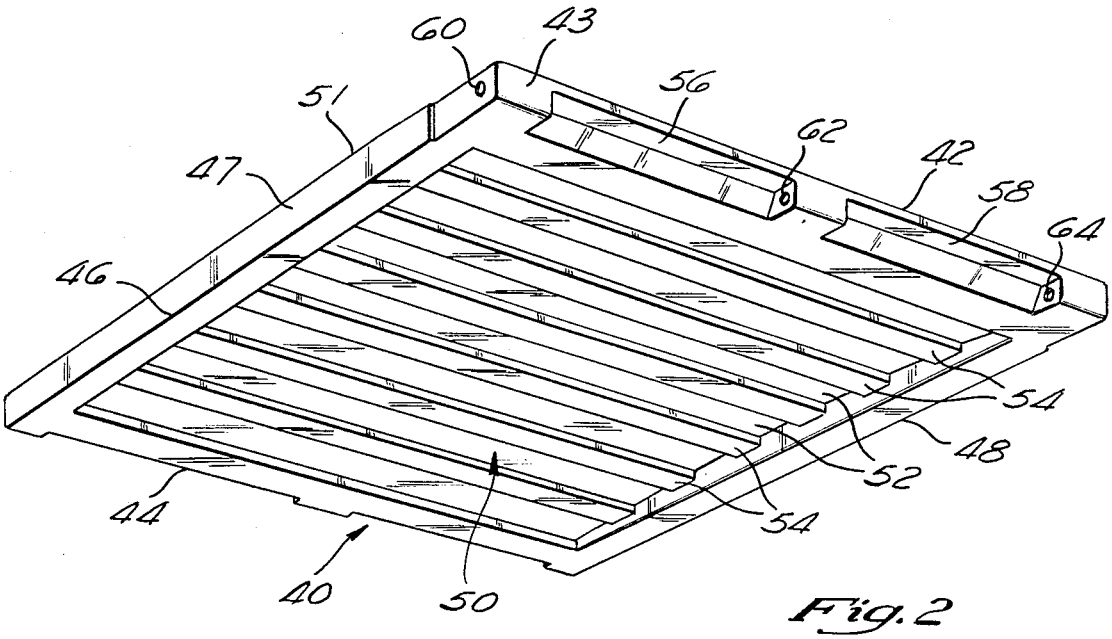
Fig. 2

REFUSE CONTAINER COVER

FIELD OF THE INVENTION

The present invention pertains generally to the materials handling arts and more particularly to an improved cover or lid for a refuse container.

BACKGROUND OF THE INVENTION

Modern solid waste handling systems frequently utilize bin type containers (e.g. "dumpster bins") for holding and/or transporting quantities of trash, refuse or other solid waste. Such bin-like containers are frequently positioned out of doors, at strategic locations within walking distance of homes, apartments, places of business, etc. Also, such bin like containers are often specially adapted to be carried and/or dumped by truck mounted fork lift mechanisms.

Because these bin like containers are frequently positioned out of doors they are generally open to the elements and may be exposed to substantial amounts of rain, snow, sleet, etc. Accordingly, it is desirable that such bin like containers be provided with lids or covers to prevent the entry of rain water, snow etc. into the interior of the container. Additionally, it is desirable that such cover(s) be of generally light weight construction so as to be easily removable/replaceable by persons who wish to deposit refuse within the interior of the container. Finally, it is also desirable that the lid or cover be configured so as not to hold quantities of rain water, snow ice or the like as would result in substantial difficulty of use.

Many of the standard bin type refuse containers of the prior art have incorporated sheet metal and/or wooden lids which are quite heavy, tend to rust or degrade and are relatively expensive to fabricate. Accordingly, there remains a need in the art for an improved refuse container lid which is light weight, easily reproducible and relatively inexpensive to manufacture and configured so as not to hold rain water and the like.

BRIEF DESCRIPTION OF THE INVENTION

In view of the above stated shortcomings of the prior art, the present invention provides an improved refuse container cover formed of generally light weight, durable plastic and pivotally attachable to the horizontal, diagonal or vertical opening of a bin type refuse container.

In accordance with the invention, there is provided a refuse container lid having an upper surface, lower surface and a plurality of lateral edges. Mounting means, such as apertures, are provided so as to render the lid pivotally attachable to a desired refuse container by way of a hinge, pivot bar or similar means.

Further in accordance with the present invention, the upper surface of the refuse container cover of the present invention is provided with a series of generally parallel ridges or gutters for channeling of rain water and the like. In a preferred embodiment, the central area of the upper lid surface is somewhat raised or peaked so as to cause rain water to run through the generally parallel channels to the edges of the upper lid surface. By such arrangement, rain water is prevented from pooling on the upper lid surface.

Still further, in accordance with the present invention, the refuse container lid may comprise a two-piece embodiment formed of separate upper and lower halves, said upper and lower halves being juxtapositionable and conjoinable along a common plane so as to form a refuse container lid of substantially unitary structure. The upper half of the lid will generally comprise an upper lid surface, including a plurality of generally parallel ridges or ribs formed thereon so as to carry out the above described rain guttering function. The corresponding lower half of the lid will generally comprise the undersurface or underside of the lid and will include a plurality of ribs, cross members, braces, or the like formed thereon or therein to impart a desired degree of rigidity and strength. In a preferred embodiment, the ribs, braces, cross members or other strength imparting structures of the lower half extend transversely (from side to side) across the lower surface of the assembled refuse container lid while the ribs, ridges or other rain gutter forming structures of the upper half extend longitudinally (from rear edge to front edge) on the upper surface thereof. Thus, the generally parallel rain gutters or channels on the upper surface of the lid are arranged to run generally perpendicular to the ribs or other straight-imparting structures formed on the under surface of the lid. Such cross directional reinforcement/ribbing imparts structural stability and strength to the unitary lid structure and renders such refuse container lid resistant to bending or torsional disfigurement.

Further still, in accordance with the invention, the refuse container lid may comprise a single-piece embodiment, similar in character to the upper half of the above described two-piece refuse container lid and adapted to be directly connected to a refuse container without being juxtapositioned and/or conjoined with any other lid structure. The single piece refuse container lid of the present invention may incorporate a plurality of insert rods or braces running transversely across the underside thereof to impart strength or rigidity. Generally, the rods or braces will run in a direction perpendicular to a plurality of ribs, ridges, channels or other rain gutter forming structures formed on the upper surface of the lid.

The inclusion of such rod inserts/braces imparts substantial rigidity and resistance to torsional deformation and renders such single-piece member capable of being used as a refuse container lid without the added rigidity or strength generally attributable to the lower half of the above-described two-piece refuse container lid.

Further in accordance with the invention, the single-piece refuse container lid of the present invention may be formed by rotational molding. (i.e. "rotomolding") In a preferred method of rotationally molding the single-piece refuse container lid of the invention, first and second directly opposing mold cavities are provided. The first and second mold cavities are generally mirror images of one another such that, when the mold is closed, a single-piece, generally hollow part may be rotomolded therewithin and subsequently cut in half so as to form two separate, substantially identical parts. A plurality of plastic, metal or wooden rods or other strength-imparting inserts may be positioned within each half of the mold prior to the rotational molding of the plastic material therearound. After demolding, the hollow part will then be cut into two separate, substantially identical halves—each such half comprising a separate single-piece refuse container lid of the present invention with a plurality of the rods or other inserts being molded in place therewithin. Thus, two separately reinforced, single-piece refuse container lids are formed by a single molding cycle or "shot".

A principal object of the invention is to provide an improved refuse container lid which exhibits a desirable strength to weight ratio, desirable rigidity and other desirable physical properties while being designed so as to cause rain water to be channeled or guttered from the upper surface thereof.

Another object of the invention is to provide an improved refuse container of the foregoing character which may be easily, rapidly and reproducibly manufacturable.

Further objects and advantages of the present invention will become apparent to those skilled in the art upon reading and understanding of the following detailed description and the accompanying drawings.

BRIEF DESCRIPTION OF THE DRAWINGS

FIG. 1 is a perspective view of the upper half of a preferred two-piece refuse container lid of the invention.

FIG. 2 is a perspective view of a lower half of a preferred two-piece refuse container lid of the present invention.

DETAILED DESCRIPTION OF PREFERRED EMBODIMENTS

Figure 3:
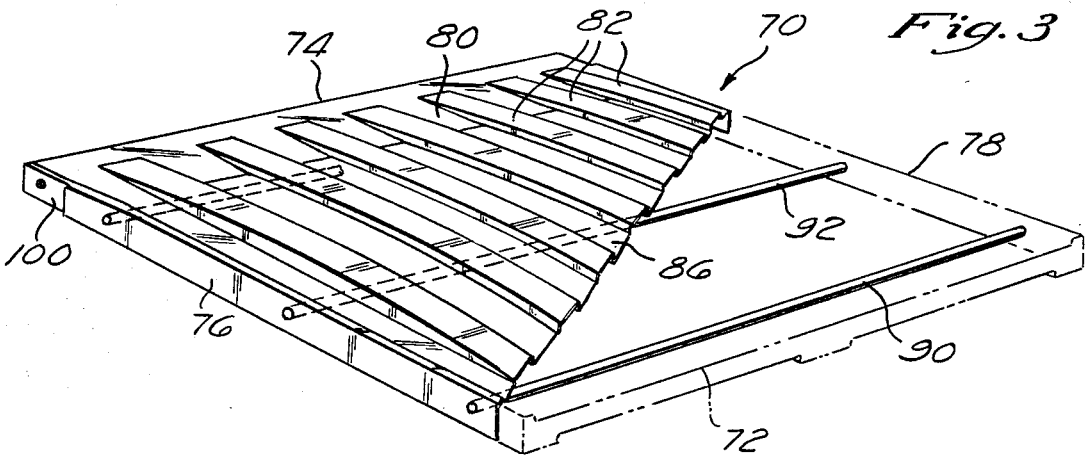
FIG. 3 is a perspective view of a preferred one-piece refuse container lid of the present invention.

The accompanying drawings are provided for purposes of illustrating presently preferred embodiments of the invention and are not intended to limit the scope of the invention in any way.

i. A PREFERRED TWO-PIECE REFUSE CONTAINER COVER

Referring to the drawings, FIGS. 1 and 2 show, respectively, the upper and lower halves of a two-piece refuse container cover of the present invention. The upper half (FIG. 1) comprises a generally rectangular member 10 having a platform like body with a top side 12, an underside 14, a rear edge 16, a front edge 18, and two lateral edges 20 and 22. In this preferred embodiment lip members 17, 19, 21 and 23 extend downwardly from each of said rear edge 16, front edge 18, and lateral edges 20, 22. Such lips 17, 19, 21 and 23 or flanges extend generally perpendicular to and in a common direction from the outer periphery of the platform like body so as to form a slightly cuped or concave structure.

A plurality of ribs 24 are formed on the upper surface 12 of the platform like upper member 10. Such ribs 24 are generally parallel to and equidistant from one another, running generally from points near the rear edge 16 to points near the front edge 18 of the member 10. Accordingly, a plurality of parallel troughs or gutters 26 are formed in the regions between the raised ribs 24.

Apertures 28 are formed through lateral edge lips 21 and 23 at points near the rear edge 16 of the member. Such apertures 28 allow passage of a pivot bar, pin or other means for pivotally affixing the assembled refuse container lid to a desired horizontal, vertical or slanted refuse container opening.

The formation of lips 17, 19, 21, 23 around the periphery of the member 10 renders the underside 14 of the platform like upper member 10 somewhat concave so as to be slidably receptive of the corresponding lower portion (FIG. 2) of this two-piece embodiment.

The lower portion (FIG. 2) of the two-piece embodiment comprises a generally rectangular platform like member 40 having a rear edge 42, a front edge 44 and two lateral side edges 46 and 48. Lips 43, 47 extend perpendicularly upward from the edges 42, 44, 46, 48 of the lower platform like member 40. The underside 50 of the lower member 40 comprises a generally arched panel surface 52 having a plurality of ribs 54 formed on the surface thereof, such ribs 54 extending transversely between lateral edge 46 and lateral edge 48.

The front 44, rear 42 and lateral 46, 48 edges form an outer perimeter or frame like periphery extending around the platform like lower member 40. Elongate notches are formed in the rear edge 42 of the lower member 40 and form interuptions in in lip 43. Apertures 60, 62, 64 are in alignment with one another so as to permit passage therethrough of a pin, pivot bar or other means for pivotally attaching the refuse container lid to a desired horizontal, slanted or vertical refuse container opening.

The lower member 40 is sized and configured to be slidably advancable into or otherwise conjoinable in juxtaposition with the underside 14 of the upper member 10, thereby forming the desired unitary refuse container lid structure. In this preferred embodiment, the lower portion (FIG. 2) is slightly smaller in longitudinal and lateral dimension then the upper portion (FIG. 1) so as to slide into the concave underside of the upper portion. Thus the outer surface of lower member lateral side lips 47 will preferrably slide against the inner surface of upper member lateral side lips 21, 23 to form a box-like, unitary structure. Adhesive, or other means, will then be applied to fuse the upper and lower portions in such joined configuration.

The upper surface of the arched panel 52 is specifically configured to correspond with the underside 14 of arched panel 26 of the upper member 10. Thus, when the lower member 40 is positioned advanced into or placed in juxtaposition with the underside 14 of upper member 10 the upper side of the arched panel 52 of lower member 40 will be generally equidistant at any given point from the underside 14 of arched panel 26 of the upper member and/or ribs 24. As a result of such configuration, isolated areas of downward compressive force applied to the upper member 10 will result in little or no indentation of the upper member 10 because all points on the upper surface 12 of the upper member 10 are in abutment with or close-spaced (e.g. less than one inch) to the underlying upper surface 51 of lower member 40.

The upper 10 and lower 40 members of this preferred two-piece embodiment may be manufactured by vacuum forming of a suitable thermoplastic or thermosetting material. It is desirable that the plastic material used to form the upper 10 and lower 40 members be capable of withstanding a wide range of environmental conditions, and that such material(s) exhibit substantial impact resistance over a working range of temperatures which approximate the environmental temperatures in which the refuse container will be used.

Because many refuse containers are dumped into collection trucks by way of automated dumping mechanisms it is desirable that the material of which the lid is formed be capable of withstanding repeated slamming, bumping and/or other impact as may be incurred during such procedures. Additionally, because most refuse containers are routinely positioned out of doors, it is desirable that plastic materials used in the manufacture of such containers/lids be formulated with a suitable ultraviolet protectant, ultraviolet inhibitor, pigment, dye or other substances incorporated into the material so as to prevent or minimize any degratory effect of continued ultraviolet exposure.

ii. A PREFERRED SINGLE-PIECE REFUSE CONTAINER LID

Figure 4:
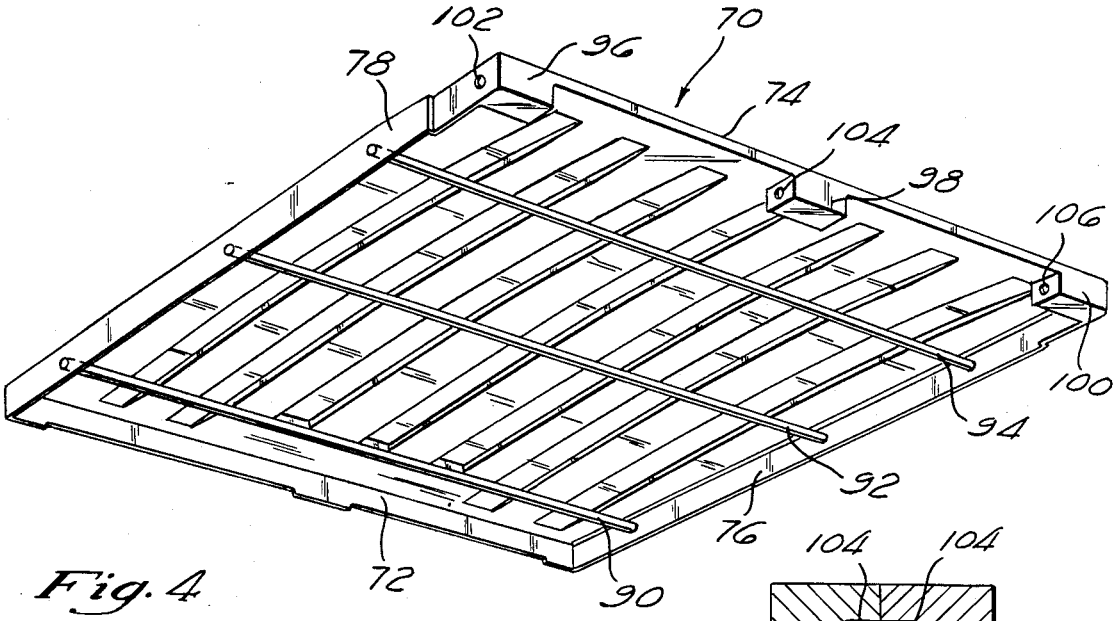
FIG. 4 is a bottom plan view of a preferred one-piece refuse container lid of the present invention showing the plurality of insert bars positioned therewithin.
Figure 5:
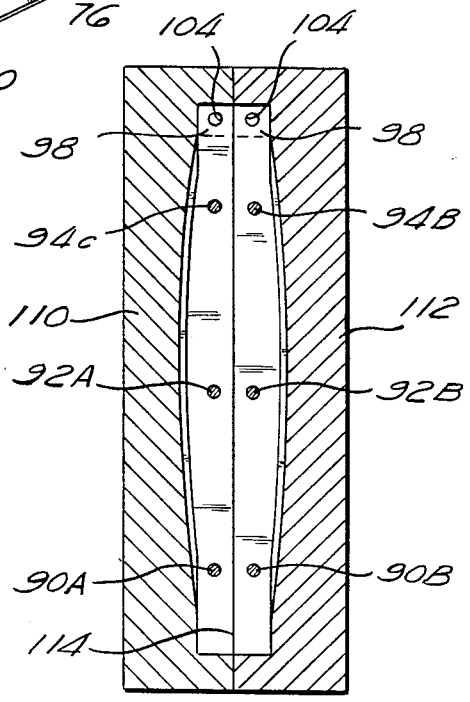
FIG. 5 is a cross sectional view of a presently preferred tool for rotationally molding two separable units of the one-piece refuse container lid shown in FIGS. 3 and 4.

A second preferred embodiment of the invention, comprising a single-piece refuse container lid, is shown in FIGS. 3–5. As shown, the preferred single piece refuse container lid 70 comprises a slightly bowed, currugated panel 86 having a front edge lip 72, a rear edge lip 74, and two lateral edge lips 76, 78 extending downwardly from the outer periphery thereof. The upper surface 80 of the corrugated panel 86 comprises a slightly arcuate, peaked or bowed surface having a plurality of raised ribs 82 protruding upwardly therefrom and running generally parallel to one another. The ribs 82 extend longitudinally from points near the rear edge of the panel 86 to points near the front edge of the panel 86. In this preferred embodiment, the ribs 82 are nothing more than the upward presentations of the alternate corrugations or raised areas formed within the panel 86. (as specifically shown in the cut away view of FIG. 3.)

A plurality of support members 90, 92, 94 extend transversely across the underside of panel 86 and are anchored or affixed at either end against the inner surfaces of lateral edge lips 76, 78. Each such support member 90, 92, 94 comprises a length of steel or plastic tube or rod. Such section of rod or tube are inserted or otherwise positioned within the part so as to impart structural rigidity and strength. Also, as will be described more fully herein, one method of manufacturing the single piece refuse container is by rotational molding of a single, hollow part comprising two mirror image halves. Such hollow part is then severed along an axis of symetry so as to split the part into two single piece refuse container covers. In such manufacturing method, the rod, tube or other support members may be inserted into the interior of the mold so as to be formed in place during the subsequent molding of the part. Alternatively, the rods, tubes or other support members may be inserted into the individual single piece refuse container covers after molding and severance thereof.

A plurality of hinge members 96, 98, 100 are attached to and positioned along the rear edge 74 of the lid. Each such hinge member 96, 98, 100 is provided with an aperture 102, 104, 106 extending therethrough and aligning with one another so as to permit passage therethrough of a pin, pivot rod or other member to pivotally attach the lid 70 to an under positioned refuse container. The individual hinge members 96, 98, 100 may comprise separate blocks or inserts made of metal or any other suitable material. Or, such individual hinge members 96, 98, 100 may be formed of the same material as the remainder of the lid 70 and may in fact be molded as a unitary structure with the remainder of the lid.

One presently preferred means of manufacturing the single-piece refuse container lid 70 is by rotational molding (e.g. "rotomolding"). A preferred tool for rotationally molding the above described single-piece refuse container lid 70 of the invention is shown in FIG. 5. As shown, the tool comprises a first mold half 110 and a second mold half 112. Both mold halves 110 and 112 have substantially identical mold cavities formed therein. When the opposite mold halves 110, 112 are placed in direct juxtaposition so that they abut one another along parting line 114, the substantially identical cavities of the mold halves 110 and 112 come together to form a single major cavity within the tool. The major cavity is symmetrical on either side of the mold parting line 114. Thus, a single generally hollow part rotationally molded within the major cavity of the tool will consist of two (2) mirror image halves formed on either side the parting line. After such rotomolded part has been demolded, it may then be cut along its line of symmetry to obtain two (2) separate mirror image parts, each such mirror image part comprising a single-piece refuse container cover of the present invention.

In this presently preferred method of rotationally molding the single-piece refuse container cover of the invention the tubular support members 90A, 90B, 92A, 92B, 94A, 94B are inserted into and positioned within the mold cavities prior to molding. In this preferred embodiment, the individual support members 90A, 90B, 92A, 92B, 94A, 94B comprise precut sections of half inch steel rod. The inner surfaces of the mold halves 110, 112 are provided with lugs, ridges, slots or other mounting means for holding the individual precut sections of steel rod in place as the mold is closed. Thereafter the rotational molding of the plastic about the walls of the mold gives rise to a generally hollow molded article having six support rods 90A, 90B, 92A, 92B, 94A, 94B molded in place therein within the hollow interior thereof.

Although the invention has been described herein with respect to a number of presently preferred embodiments, it must be appreciated that numerous alterations, modifications and additions may be made to such embodiments without departing from the spirit and scope of the invention. For example, the vacuum formed two-piece embodiment described and shown in FIGS. 1 and 2 may be manufactured of any suitable material and need not be vacuum formed—although vacuum forming is presently preferred and has been fully described herein. Likewise, the rotationally molded single-piece embodiment shown in FIGS. 3–5 need not be rotationally molded and may be formed by any suitable means and of any suitable material. Accordingly it is intended to include all such additions, modifications, and alterations within the scope of the following claims and the equivalents thereof.

I claim:

1. A refuse container cover comprising:

an upper member comprising a generally rectangular platform like body having an upper surface and a lower surface, a front edge, a rear edge and two lateral side edges extending between said front and rear edges;

a lower member comprising a generally rectangular platform like body having an upper surface a lower surface, a front edge, a rear edge and two lateral side edges extending between said front and rear edges;

said upper and lower members being joined in coplanar juxtaposition such that the lower surface of the upper member is generally opposite the upper surface of the lower member, such joining of the upper and lower members resulting in the formation of a generally unitary refuse container cover structure;

means for connecting said cover to a refuse container such that said cover will be movable (a) between an "open position" whereby access to the interior of said refuse container is permitted and (b) a "closed" position whereby access to the interior of said refuse container is substantially precluded;

a plurality of first elongate ribs formed on said upper member, said first elongate ribs being in generally parallel relation to one another and oriented in a first direction; and a plurality of second elongate ribs formed on said lower member, said second elongate ribs being in generally parallel relation to one another and oriented in a second direction generally perpendicular to said first direction.

2. The refuse container cover of claim 1 wherein:

said upper member further comprises a rear edge lip, a front edge lip and two lateral edge lips formed about the periphery thereof and extending in a generally downward direction therefrom.

3. The refuse container cover of claim 1 wherein:

said lower member further comprises a rear edge lip, a front edge lip and two lateral edge lips formed about the periphery thereof and extending in a generally upward direction therefrom.

4. The refuse container cover of claim 1 wherein:

said upper member further comprises a plurality of water channeling troughs formed on the upper surface thereof.

5. The refuse container cover of claim 4 wherein the said plurality of water channeling troughs comprises a series of generally parallel grooves formed within the upper surface of said upper member.

6. The refuse container cover of claim 4 wherein:

said plurality of water channeling troughs comprise a plurality of raised ribs formed on the upper surface of the upper member with a plurality of non-raised areas being defined therebetween, said non-raised areas comprising the said water channeling troughs.

7. The refuse container cover of claim 4 wherein:

said water channeling troughs comprise a plurality of generally parallel grooves positioned between generally parallel raised ribs formed on said upper surface.

8. The refuse container cover of claim 1 wherein said lower member further comprises a plurality of ribs formed thereon so as to impart added strength to said unitary refuse container cover structure.

9. The refuse container cover of claim 8 wherein:

the ribs formed on said lower member extend transversely between said first and second lateral edges.

10. The refuse container cover of claim 4 wherein:

the parallel water channeling troughs formed on the upper surface of the upper member extend longitudinally between said front edge and said rear edge.

11. The refuse container cover of claim 1 wherein said upper surface of said upper member is arched to promote run of of rain water through said water channeling troughs.

* * * * *